US007212779B2

(12) United States Patent
Yanagizawa et al.

(10) Patent No.: US 7,212,779 B2
(45) Date of Patent: May 1, 2007

(54) ELECTROCONDUCTIVE BRUSH AND COPYING DEVICE FOR ELECTROPHOTOGRAPHY

(75) Inventors: Hirofumi Yanagizawa, Moriyama (JP); Yukio Mori, Konan (JP); Shoichi Tsukada, Moriyama (JP)

(73) Assignee: Gunze Limited, Kyoto (JP)

( * ) Notice: Subject to any disclaimer, the term of this patent is extended or adjusted under 35 U.S.C. 154(b) by 180 days.

(21) Appl. No.: 10/500,304

(22) PCT Filed: Mar. 6, 2003

(86) PCT No.: PCT/JP03/02619

§ 371 (c)(1),
(2), (4) Date: Nov. 12, 2004

(87) PCT Pub. No.: WO03/077041

PCT Pub. Date: Sep. 18, 2003

(65) Prior Publication Data

US 2005/0063745 A1 Mar. 24, 2005

(30) Foreign Application Priority Data

Mar. 12, 2002 (JP) ..... 2002-067099

(51) Int. Cl.
*G03G 21/00* (2006.01)

(52) U.S. Cl. ..... 399/353

(58) Field of Classification Search ..... None
See application file for complete search history.

(56) References Cited

U.S. PATENT DOCUMENTS 2,689,791 A 9/1954 Boag
5,689,791 A 11/1997 Swift
5,805,961 A * 9/1998 Mizoe et al. ..... 399/174
2002/0164478 A1 * 11/2002 Naghibi ..... 428/364

FOREIGN PATENT DOCUMENTS

| | | |
|---|---|---|
| EP | 0 609 892 A1 | 8/1994 |
| EP | 6 098 92 | 8/1994 |
| EP | 10 910 26 | 9/2000 |
| EP | 1 091 026 A1 | 4/2001 |
| JP | 6-106109 | 5/1986 |
| JP | 61-106109 | 5/1986 |
| JP | 8-328356 | 1/1996 |
| JP | 08-272188 | 10/1996 |
| JP | 8-328356 | 12/1996 |
| JP | 10-333359 | 12/1998 |

OTHER PUBLICATIONS

Japanese Office Action dated May 30, 2006 of corresponding Japanese Application No. 2003-575193.

* cited by examiner

*Primary Examiner*—Quana Grainger
(74) *Attorney, Agent, or Firm*—Westerman, Hattori, Daniel & Adrian, LLP.

(57) ABSTRACT

The purpose of the invention is to provide a conductive brush excelling in functionality and being useful as a cleaning brush in the color copier using the color toner of fine grain than before.

Figure 1:
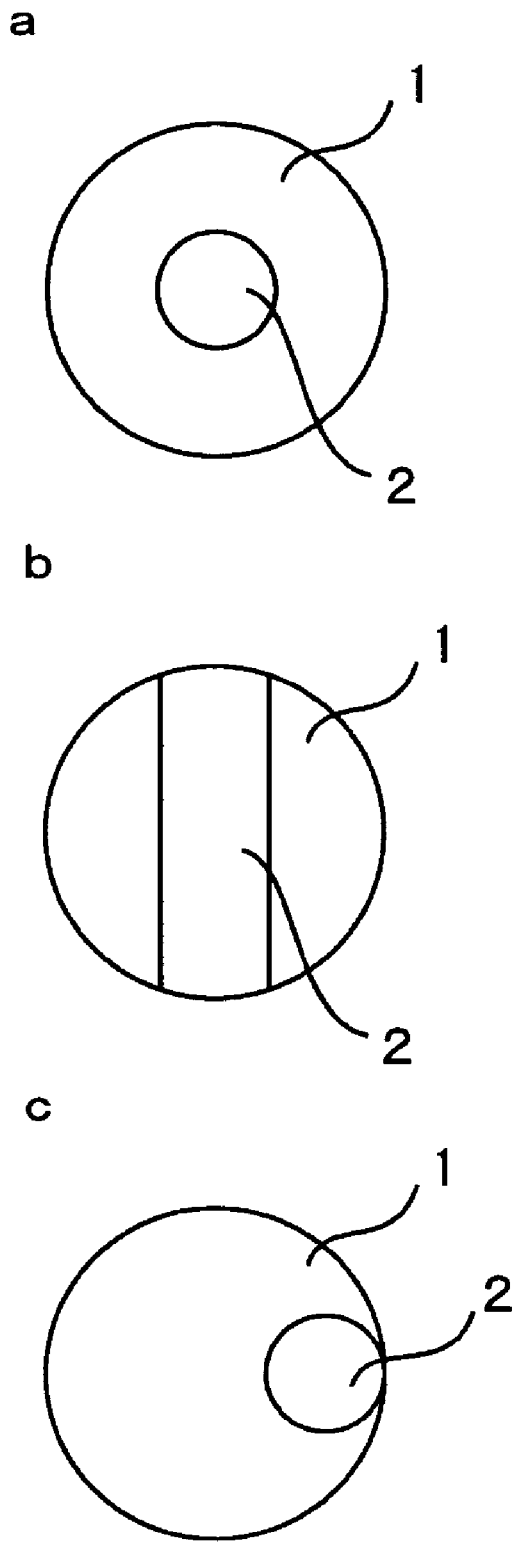

The present invention is a conductive brush, which comprises a base fabric and a mixed fiber of a polyethylene terephthalate fiber and a nylon-66 fiber being raised on the base fabric by pile-flocking and, said polyethylene terephthalate fiber and/or said nylon-66 fiber having a volume resistivity of $10^0$ to $10^6$ Ω·cm.

10 Claims, 1 Drawing Sheet

ELECTROCONDUCTIVE BRUSH AND COPYING DEVICE FOR ELECTROPHOTOGRAPHY

TECHNICAL FIELD

The invention relates to a conductive brush used for a member of an electrophotographic copying device such as a color copier. Specifically, the invention relates to a conductive brush useful as a (toner) cleaning brush.

BACKGROUND ART

Conductive brushes having a stripe or columnar shape comprising a fiber being pile-flocked on a base fabric, said fiber comprises, partially or entirely, nylon fiber, tetron fiber, acrylic fiber, fluorine fiber having conductivity, and the like, are used for applications such as various cleaning, discharging or charging. Above all, a conductive brush for cleaning, charging or discharging used for an electrophotographic copying device such as a color copier is required to possess extremely high functions than those for the conductive brushes used in other fields. Therefore, the kind of fiber, conductivity, thickness of fiber, density of piles and the like are required to be selected so as to satisfy the functions.

On the other hand, various manufacturers of copying machine always investigate higher image quality and decreasing of consumption of toner in view of both hardware and software as the most important problem of copying using an electrophotographic copying device. Recently, as a means for dissolving such problems, use of a color toner having smaller particle size has been investigated. However, when such color toner having smaller particle size is used, cleaning property becomes insufficient even a conventional conductive brush is used as a (toner) cleaning brush for a photosensitive drum or an intermediate transfer belt in an electrophotographic copying device, which causes a problem that the contamination of paper (printing contamination) by the residual toner sometimes occurs.

SUMMARY OF THE INVENTION

In view of the above-mentioned problems, the invention aims at providing a conductive brush, which can carry out cleaning effectively even when a color toner having small particle size is used, and can prevent contamination of paper, when used as a (toner) cleaning brush for a photosensitive drum or an intermediate transfer belt in an electrophotographic copying device.

The present invention is a conductive brush, which comprises a base fabric and a mixed fiber of a polyethylene terephthalate fiber and a nylon-66 fiber being raised on the base fabric by pile-flocking and, said polyethylene terephthalate fiber and/or said nylon-66 fiber having a volume resistivity of $10^0$ to $10^6$ Ω·cm.

In a preferred embodiment, the base fabric comprises a multifilament of 40 to 130 dtex as a weft (T) and a warp (Y), and the polyethylene terephthalate fiber and the nylon-66 fiber constituting the mixed fiber are each a multifilament of 40 to 130 dtex comprising monofilaments of 0.5 to 20 dtex.

In a preferred embodiment, a part or all of the weft (T) and/or the warp (Y) in the base fabric comprises a thermoplastic resin having a melting point of 20 to 100° C. lower than those of the polyethylene terephthalate fiber and the nylon-66 fiber.

In further preferred embodiment, the polyethylene terephthalate fiber has a conjugate structure congregated a conductive carbon black in a central portion and a volume resistivity of $10^0$ to $10^6$ Ω·cm and, the nylon-66 fiber has a volume resistivity of not less than $10^{13}$ Ω·cm.

An electrophotographic copying device which comprises the conductive brush to of the invention installed as a cleaning brush is also one of the invention.

BRIEF DESCRIPTION OF THE DRAWING(S)

FIG. 1 is an illustration of a schematic cross-section view of fibers having a conjugate structure. In the drawings, 1 is a peripheral portion comprising a resin, and 2 is a central portion comprising a conductive material.

DETAILED DISCLOSURE OF THE INVENTION

Hereinafter the invention is explained in detail.

The conductive brush of the invention comprises a base fabric and a mixed fiber of a polyethylene terephthalate (hereinafter also referred to as PET) fiber and a nylon-66 fiber, said mixed fiber being raised on the base fabric by pile-flocking.

The present inventors have done intensive studies and found that use of a mixed fiber comprising the combination of a PET fiber and a nylon-66 fiber greatly improves the cleaning property of a conductive brush, and can prevent contamination of paper effectively even when a color toner having small particle size is used, which resulted in the completion of the invention.

The PET fiber is not specifically limited and includes those obtained by a known method comprising melt-spinning and drawing of a PET polymer.

The PET polymer can include, for example, a PET obtained by polycondensation of ethylene glycol and terephthalic acid, a copolymer in which a part of an ethylene glycol component of PET has been replaced with other aliphatic diol, or a copolymer in which a part of a terephthalic acid component has been replaced with other aromatic dicarboxylic acid, to the extent that the nature of PET is not modified, and the like. Furthermore, the PET polymer can comprise, if needed, a small amount of a known additive.

The nylon-66 fiber is not specifically limited and includes those obtained by a known method comprising melt-spinning and drawing of an aliphatic polyamide.

The aliphatic polyamide can include, for example, nylon-66 obtained by polycondensation of adipic acid and hexamethylenediamine, a copolymer in which a part of an adipic acid component has been replaced with other aliphatic dicarboxylic acid, or a copolymer in which a part of a hexamethylenediamine component has been replaced with other aliphatic diamine, to the extent that the nature of nylon-66 is not modified and the like. Furthermore, the aliphatic polyamide can comprise, if needed, a small amount of a known additive.

At least one of the above PET fiber and the nylon-66 fiber has a volume resistivity of $10^0$ to $10^6$ Ω·cm. Due to this, the cleaning brush comprising the conductive brush of the invention can remove dust, dirt and the like while neutralizing by removing charge. Therefore, the brush can remove dust, dirt and the like completely, certainly and easily, compared with removal solely by physical wiping. Furthermore, the conductive brush of the invention can be used as a charging brush and a discharging brush. When the volume resistivity is less than $10^0$ Ω·cm, for example, the brush turns on electricity in the case where it contacts with an organic photo-conductor, and when the volume resistivity is more than $10^6$ Ω·cm, the brush can not remove dust, dirt and the like while removing charge and neutralizing, which leads to insufficient efficiency of removal.

The method for providing conductivity to the PET fiber or the nylon-66 fiber is not specifically limited, and includes, for example, a method comprising incorporating a conductive material such as a conductive carbon powder, a conductive metal powder in the PET fiber or the nylon-66 fiber, in an amount depending on the desired conductivity, and the like.

The PET fiber or the nylon-66 fiber including the conductive material includes, for example, a fiber in which a conductive material has been mixed and dispersed uniformly; a fiber having a conjugate structure in which a conductive material is congregated in the central portion and the peripheral portion is surrounded by a resin, and the like. Above all, the fiber having a conjugate structure is preferred since it can maintain the superior property of the PET fiber or the nylon-66 fiber and can provide high conductivity by a small amount of conductive material. FIG. 1 illustrates a schematic drawing of a cross-section of fibers having a conjugate structure. In FIG. 1, the conductive material 2 may be congregated in the center of the peripheral portion comprising the resin 1 in a columnar shape (FIG. 1*a*), or may be congregated in a belt shape (FIG. 1*b*). Furthermore, the conductive material 2 is preferably exposed partially on the surface of the fiber as shown in FIGS. 1*b* and 1*c*. In the fiber having a conjugate structure, the central portion comprising the conductive material preferably comprises some amount of the same kind of resin as the resin that constitutes the peripheral portion so that the conductive material particles are bound each other and the affinity to the peripheral portion is improved.

The method for producing the fiber in which the conductive material has been mixed and dispersed uniformly is not specifically limited, and includes, for example, a method comprising uniformly mixing and dispersing the conductive material in a raw material resin in advance and melt spinning the dispersion, and the like.

The method for producing the fiber having a conjugate structure is not specifically limited, and a conventionally known method can be used. For example, a method comprising simultaneously spinning using a double die, which comprises a die for the conductive material in the central portion and a die for the resin surrounding said die, and the like.

Although the PET fiber and the nylon-66 fiber are not limited in terms of mechanical properties such as Young's modulus, tension strength, tension elongation, Izod impact strength and thermal properties, they are preferably fibers being not crimped.

The PET fiber and the nylon-66 fiber are preferably multifilament in which monofilaments are bundled. In this case, the fiber thickness of each of the monofilaments constituting the multifilament is preferably 0.5 to 20 dtex. When the thickness is less than 0.5 dtex, the multifilament being flocked does not have elasticity, which leads to bad cleaning property of the conductive brush of the invention. On the other hand, when the thickness is more than 20 dtex, the density of flocking becomes low, which leads to bad cleaning property of the conductive brush of the invention. More preferably, the thickness is 1 to 15 dtex. Although a multifilament generally comprises monofilaments having the same thickness, it may comprise monofilaments having different thickness in a bundle. By bundling the monofilaments having different thickness, the properties of the PET fiber and the nylon-66 fiber may differ slightly. Furthermore, the thickness of the multifilament is preferably 40 to 130 dtex. When the thickness is less than 40 dtex, the multifilament being flocked does not have elasticity, which leads to bad cleaning property of the conductive brush of the invention. On the other hand, when the thickness is more than 130 dtex, the density of flocking becomes low, which leads to bad cleaning property of the conductive brush of the invention.

Although the shape for the cross-section of the PET fiber and the nylon-66 fiber is not specifically limited, it is generally circular. However, shapes other than circular make little difference in properties of the PET fiber and the nylon-66 fiber.

The mixed fiber of the PET fiber and the nylon-66 fiber includes not only a yarn for pile-flocking obtained by twisting and bundling the PET fiber and the nylon-66 fiber, but also a yarn for pile-flocking which provides mixture of the PET fiber and the nylon-66 fiber as a whole after the PET fiber and the nylon-66 fiber are alternately pile-flocked on a base fabric. Above all, the yarn for pile-flocking obtained by twisting and bundling the PET fiber and the nylon-66 fiber is preferred in view of the properties of the mixed fiber and the efficiency of pile-flocking (working property).

The ratio of the PET fiber relative to the nylon-66 fiber in the mixed fiber is 25 to 75% (converted to thickness). In this range, the conductive brush of the invention has an extremely superior cleaning property. More preferably, the ratio is 40 to 60%.

Although the combination of the volume resistivities of the PET fiber and of the nylon-66 fiber in the mixed fiber of the PET fiber and the nylon-66 fiber is not specifically limited, the case wherein the polyethylene terephthalate fiber has a conjugate structure in which a conductive carbon black is congregated in a central portion, and has a volume resistivity of $10^0$ to $10^6$ Ω·cm, and wherein the nylon-66 fiber has a volume resistivity of not less than $10^{13}$ Ω·cm is preferable, since the conductive brush has a specifically high cleaning property.

Although the weft (T) and the warp (Y) of the base fabric are not specifically limited so long as they are yarn fibers each having a certain strength that allows weaving, a part or all of the weft (T) and/or the warp (Y) preferably comprises a thermoplastic resin having a melting point being 20 to 100° C. lower than those of the polyethylene terephthalate fiber and the nylon-66 fiber. Since a part or all of the weft (T) and/or the warp (Y) comprise such a thermoplastic resin, the back surface of the base fabric can be fixed by melt adhesion during back fixing carried out for preventing removal of pile yarn after pile-flocking, which provides stronger prevention of removal of yarn. More preferably, the weft (T) and/or the warp (Y) are a mixed fiber of a fiber comprising a thermoplastic resin having a melting point being 20 to 100° C. lower than those of the polyethylene terephthalate fiber and the nylon-66 fiber, and a fiber comprising a thermoplastic resin having a melting point being higher than that of said thermoplastic resin.

The thermoplastic resin having a melting point being 20 to 100° C. lower than those of the polyethylene terephthalate fiber and the nylon-66 fiber is not specifically limited, and includes, for example, copolymers comprising PET as a main component unit such as aliphatic polyamide resins such as nylon-6, nylon-610, nylon-11, nylon-12. Above all, aliphatic polyamide resin is preferred since it is superior in melt adhesive property, adhesive property (e.g., property for adhesion with a back coating adhesive), some antistatic property (some moisture absorbing property), and the like.

The base fabric preferably uses a multifilament for a weft (T) and a warp (Y). The thickness of the multifilament constituting the weft (T) and the warp (Y) in the base fabric is not specifically limited, and is preferably 40 to 130 dtex. When the thickness is less than 40 dtex, the constriction force of the base fabric is decreased and the flocked fibers are sometimes removed. On the other hand, when the thickness is more than 130 dtex, the density of flocking becomes low, which sometimes leads to bad cleaning property.

The method for pile-flocking the mixed fiber on the base fabric is not specifically limited, and includes, for example, a method by knitting, a method by weaving and the like. Above all, a method comprising incorporating the mixed multifilament on the base fabric while weaving the weft (T) and the warp (Y) to form piles is preferred. Furthermore, the pile-flocking is preferably carried out by V-flocking. In this method, two pile whole clothes can be obtained simultaneously by cutting the central portion of the V-shaped flocked portion.

The density of the pile-flocked by the pile-flocking is not specifically limited, and preferably $10^4$ to $10^5$ piles/cm$^2$. In this range, the piles become velvet-like and have strong elasticity. Alternatively, when the pile-flocking is carried out by incorporating the mixed fiber into the warp (Y), the number of fibers to be incorporated is 30 to 90 fibers/cm in the length and 20 to 70 fibers/cm in the width. More preferred pile density is $2\times10^4$ to $6\times10^4$/cm$^2$, and when the pile-flocking is carried out by incorporating the mixed multifilament into the warp (Y), the number of fibers to be incorporated is 35 to 70 fibers/cm in the length and 25 to 60 fibers/cm in the width.

The length of the pile raised by the pile-flocking is determined depending on the intended use, and is generally 3 to 6 mm.

The pile whole cloth obtained by the pile-flocking is cut into a suitable size, fixed on a substrate having longitudinal shape or cylindrical shape and the like, and used. Preferably an adhesive layer is formed on a back surface prior to the fixing so as to prevent removing of the pile yarn more strongly.

The method for forming the adhesive layer is not specifically limited, and can include, for example, a method comprising wet back-coating using a liquid adhesive, a method comprising dry melt-adhering a melt adhesive dry film of nylon-11, nylon-12 and the like, and the like.

When a part or whole of the weft (T) and/or the warp (Y) comprising a thermoplastic resin having a melting point being 20 to 100° C. lower than those of the polyethylene terephthalate fiber and the nylon-66 fiber, an antecedent step in which the pile whole cloth is passed through a heating tunnel to melt the surface of the base fabric is preferably applied prior to the formation of the adhesive layer.

The intended use of the conductive brush of the invention is not specifically limited, and the brush can be used as, for example, a cleaning brush, a charging brush, a discharging brush for an electrophotographic copying device. Above all, the brush can be preferably used a cleaning brush. The method for installing the conductive brush of the invention to the electrophotographic copying device is not specifically limited, and either a cleaning brush, a charging brush or a discharging brush can be installed thereto by a known method.

An electrophotographic copying device comprising the conductive brush of the invention as a cleaning brush is also one of the invention.

BEST MODE FOR CARRYING OUT THE INVENTION

Hereinafter the invention is explained in more detail with referring to the Example. However, the invention should not be construed to be limited to the Example.

Example 1

<Yarn for Pile-Flocking>

A conductive doubling multifilament for pile-flocking was prepared by doubling a conductive PET multifilament having a thickness of 44.4 dtex and a volume resistivity of $10^2$ to $10^4$ Ω·cm, which comprises a bundle of 12 monofilaments of conjugate PET each having a thickness of a single yarn of 3.7 dtex and a conductive carbon black congregated in a central portion (manufactured by Kanebo Gohsen, Ltd., Carbon Belltron, Type B31), and a non-conductive nylon-66 multifilament having a thickness of 44.4 dtex and a volume resistivity of $10^{13}$ Ω·cm, which comprises a bundle of 0.14 monofilaments of nylon-66 each having a thickness of a single yarn of 3.17 dtex (manufactured by Toray Industries, Inc.) by the ratio of 1:1.

<Yarn for Weaving (Base Fabric)>

A non-conductive nylon-6 multifilament having a thickness of 77 dtex and a volume resistivity of $10^{13}$ Ω·cm, which comprises a bundle of 10 monofilaments of nylon-6 each having a thickness of a single yarn of 7.7 dtex (manufactured by Toray Industries, Inc.) was used for both a weft (T) and a warp (Y) of a base fabric. The non-conductive nylon-6 multifilament had a melting point being about 35 to 40° C. lower than the melting point of the conductive doubling multifilament.

<Preparation of Pile Fabric>

While weaving the non-conductive nylon-6 multifilament as a weft (T) and a warp (Y), the conductive doubling multifilament was incorporated into the warp (Y), using a double pile velvet loom (V pile loom). The number of the filaments to be incorporated was 32 filaments/cm for the weft (T) and 45 filaments/cm for the warp (Y). Horizontal central cut gave two pile fabrics. The obtained two pile fabrics each had a pile length of 3.0 mm and a pile density of 37440 piles/cm$^2$, the piles were raised approximately vertically, and the feeling of fabric was velvet-like.

Comparative Example 1

Pile fabrics were prepared according to a similar manner to Example 1 except that a conductive doubling multifilament was prepared by doubling two conductive PET multifilaments used in Example 1 (manufactured by Kanebo Gohsen, Ltd., Carbon Belltron, Type B31) and used as a yarn for pile-flocking instead of the conductive doubling multifilament used in Example 1. The obtained two pile fabrics each had a pile length of 3.0 mm and a pile density of 34560 piles/cm$^2$, the piles were raised approximately vertically, and the fabrics were felt coarse rather than velvet-like.

Comparative Example 2

Pile fabrics were prepared according to a similar manner to Example 1 except that a conductive doubling multifilament was prepared by doubling a conductive nylon-6 multifilament having a thickness of 88.9 dtex, which comprises a bundle of 16 monofilaments of conjugate nylon-6 each having a thickness of a single yarn of 5.6 dtex and a volume resistivity of $10^0$ to $10^2$ Ω·cm, and conductive carbon black congregated in a central portion (manufactured by Kanebo Gohsen, Ltd., Carbon Belltron, Type 931) and the non-conductive nylon-66 multifilament used in Example 1 (manufactured by Toray Industries, Inc.) by the ratio of 1:1 and used as a yarn for pile-flocking instead of the conductive doubling multifilament used in Example 1. The obtained two pile fabrics each had a pile length of 3.0 mm and a pile density of 43200 piles/$cm^2$, the piles were raised approximately vertically, and the feeling of the fabric was velvet-like.

Comparative Example 3

Pile fabrics were prepared according to a similar manner to Example 1 except that a conductive doubling multifilament was prepared by doubling the conductive PET multifilament used in Example 1 (manufactured by Kanebo Gohsen, Ltd., Carbon Belltron, Type B31) and a non-conductive nylon-6 multifilament having a thickness of 44.4 dtex and a volume resistivity of $10^{13}$ Ω·cm, which comprises a bundle of 14 monofilaments of nylon-6 each having a thickness of a single yarn of 3.17 dtex (manufactured by Toray Industries, Inc.) by the ratio of 1:1 and used as a yarn for pile-flocking instead of the conductive doubling multifilament used in Example 1. The obtained two pile fabrics each had a pile length of 3.0 mm and a pile density of 37440 piles/$cm^2$, the piles were raised approximately vertically, and the feeling of the fabric was slightly softer than that of Example 1.

Comparative Example 4

Pile fabrics were prepared according to a similar manner to Example 1 except that a conductive doubling multifilament was prepared by doubling the conductive PET multifilament used in Example 1 (manufactured by Kanebo Gohsen, Ltd., Carbon Belltron, Type B31) and a non-conductive PET multifilament having a thickness of 44.4 dtex and a volume resistivity of $10^{13}$ Ω·cm, which comprises a bundle of 14 monofilaments of PET each having a thickness of a single yarn of 3.17 dtex (manufactured by Toray Industries, Inc.) by the ratio of 1:1 and used as a yarn for pile-flocking instead of the conductive doubling multifilament used in Example 1. The obtained two pile fabrics each had a pile length of 3.0 mm and a pile density of 37440 piles/$cm^2$, the piles were raised approximately vertically, and the feeling of the fabric was slightly coarser than that of Example 1, and there was no feeling of velvet-like.

(Evaluation)

A part of the pile fabric manufactured in Example 1 and Comparative Examples 1 and 4 was each taken as a sample and the back surface of the sample was uniformly heated by hot blast for one minute to melt the surface portion of the nylon-6 fiber. The pile fabrics prepared in Comparative Examples 2 and 3 were not subjected to this treatment since nylon-6 fiber was used for the piles.

Secondly, a hot melt dry film made of nylon-12 was superposed on the back surface, and the whole surface was heated at 180° C. while the film was slightly pressurized. An adhesive layer of nylon-12 was formed, which entirely prevented the risk of removal of yarn.

The obtained conductive brush in which removal of yarn had been prevented was cut into the width of 7 mm and length of 310 mm, and fixed onto a T-shaped stainless jig using a double-sided adhesive tape.

Using this conductive brush, toner cleaning effect was measured by the following method.

<Measurement of Toner Cleaning Effect>

2 g of black toner having a volume weight average particle size of 6.5 μm (a particle size of a generally used black toner is 7.5 μm) was approximately uniformly dispersed on the whole surface of a polycarbonate smooth flat plate (200 mm×300 mm), and the conductive brush was located horizontally and apart from the polycarbonate smooth flat plate. The conductive brush was slid (in one way) by a pressure amount of the tip portion of 1.0 mm and a sliding velocity of 100 mm/sec. After the cleaning, the number of residual black toner particles per a 1 $cm^2$ flame on the polycarbonate smooth flat plate was counted using a magnification microscope. In each flame, ◎ represents that the number of the black toner particles is not more than 3, Δ represents that the number of the black toner particles is 7 to 12, and X represents that the number of the black toner particles is not less than 13.

The distribution of the black toner prior to cleaning is $3.27\times10^{-3}$ g/$cm^2$ calculated with the assumption that the distribution is entirely uniform, which is converted to 2365444 particles/$cm^2$ of toner particle number assuming that the specific gravity is 1.2.

The measurement result of the toner cleaning effect is summarized in Table 1.

TABLE 1

| | Cleaning effect |
|---|---|
| Example 1 | ○ |
| Comparative Example 1 | x |
| Comparative Example 2 | Δ |
| Comparative Example 3 | Δ |
| Comparative Example 4 | x |

The measurement of the toner cleaning effect carried out in the Example is not an evaluation of absolute effect since it is not a test for a brush actually mounted on an electrophotographic copying device. However, the result is sufficient to presume the absolute effect since the surface of a photosensitive drum of an electrophotographic copying device comprises a polycarbonate layer and the measurement of the toner cleaning effect was carried out on a polycarbonate smooth flat plate.

INDUSTRIAL APPLICABILITY

Since the invention has the above-mentioned constitution, it is useful as a cleaning brush, a charging brush, a discharging brush and the like. Specifically, the invention can provide a conductive brush that can remove fine dust and the like as a cleaning brush and, can effectively solve the problem of contamination of printing caused by a color toner of fine grain.

The invention claimed is:

1. A conductive brush which comprises a base fabric and a mixed fiber of a polyethylene terephthalate fiber and a nylon-66 fiber being raised on the base fabric by pile-flocking and, said polyethylene terephthalate fiber and/or said nylon-66 fiber having a volume resistivity of $10^0$ to $10^6$ Ωcm and, said base fabric comprising a multifilament of 40 to 130 dtex as a weft (T) and a warp (Y) and, said polyethylene terephthalate fiber and said nylon-66 fiber constituting said mixed fiber being each a multifilament of 40 to 130 dtex comprising monofilaments of 0.5 to 20 dtex.

2. A conductive brush which comprises a base fabric and a mixed fiber of a polyethylene terephthalate fiber and a nylon-66 fiber being raised on the base fabric by pile-flocking and, said polyethylene terephthalate fiber and/or said nylon-66 fiber having a volume resistivity of $10^0$ to $10^6$ Ωcm and, said base fabric comprising a multifilament of 40 to 130 dtex as a weft (T) and/or the warp (Y) and, said polyethylene terephthalate fiber and said nylon-66 fiber constituting said mixed fiber being each a multifilament of 40 to 130 dtex comprising monofilaments of 0.5 to 20 dtex and, a part or all of said weft (T) and/or said warp (Y) in said base fabric comprising a thermoplastic resin having a melting point of 20 to 100° C. lower than those of said polyethylene terephthalate fiber and said nylon-66 fiber.

3. The conductive brush according to claim 1 or 2, wherein the polyethylene terephthalate fiber has a conjugate structure congregated a conductive carbon black in a central portion and a volume resistivity of $10^0$ to $10^6$ Ω·cm and, the nylon-66 fiber has a volume resistivity of not less than $10^{13}$ Ω·cm.

4. The conductive brush according to claim 1, wherein a part or all of the weft (T) and/or the warp (Y) in the base fabric comprises a thermoplastic resin having a melting point of 20 to 100° C. lower than those of the polyethylene terephthalate fiber and the nylon-66 fiber.

5. The conductive brush according to claim 1, wherein the polyethylene terephthalate fiber has a conjugate structure congregated a conductive carbon black in a central portion and a volume resistivity of $10^0$ to $10^6$ Ω·cm and, the nylon-66 fiber has a volume resistivity of not less than $10^{13}$ Ω·cm.

6. The conductive brush according to claim 2, wherein the polyethylene terephthalate fiber has a conjugate structure congregated a conductive carbon black in a central portion and a volume resistivity of $10^0$ to $10^6$ Ω·cm and, the nylon-66 fiber has a volume resistivity of not less than $10^{13}$ Ωcm.

7. An electrophotographic copying device, which comprises a conductive brush comprising a base fabric and a mixed fiber of a polyethylene terephthalate fiber and a nylon-66 fiber being raised on the base fabric by pile-flocking and, said polyethylene terephthalate fiber and/or said nylon-66 fiber having a volume resistivity of $10^0$ to $10^6$ Ωcm and, said base fabric comprising a multifilament of 40 to 130 dtex as a weft (T) and warp (Y) and, said polyethylene terephthalate fiber and said nylon-66 fiber constituting said mixed fiber being each a multifilament of 40 to 130 dtex comprising monofilaments of 0.5 to 20 dtex, installed as a cleaning brush.

8. An electrophotographic copying device, which comprises a conductive brush comprising a base fabric and a mixed fiber of a polyethylene terephthalate fiber and a nylon-66 fiber being raised on the base fabric by pile-flocking and, said polyethylene terephthalate fiber and/or said nylon-66 fiber having a volume resistivity of $10^0$ to $10^6$ Ωcm and, said base fabric comprising a multifilament of 40 to 130 dtex as a weft (T) and a warp (Y) and, said polyethylene terephthalate fiber and said nylon-66 fiber constituting said mixed fiber being each a multifilament of 40 to 130 dtex comprising monofilaments of 0.5 to 20 dtex and, a part or all of said weft (T) and/or said warp (Y) in said base fabric comprising a thermoplastic resin having a melting point of 20 to 100° C. lower than those of said polyethylene terephthalate fiber and said nylon-66 fiber, installed as a cleaning brush.

9. An electrophotographic copying device, which comprises a conductive brush comprising a base fabric and a mixed fiber of a polyethylene terephthalate fiber and a mixed fiber of a polyethylene terephthalate fiber and a nylon-66 fiber being raised on the base fabric by pile-flocking and, said polyethylene terephthalate fiber and/or said nylon-66 fiber having a volume resistivity of $10^0$ to $10^6$ Ωcm and, said base fabric comprising a multifilament of 40 to 130 dtex as a weft (T) and a warp (Y) and, said polyethylene terephthalate fiber and said nylon-66 fiber constituting said mixed fiber being each a multifilament of 40 to 130 dtex comprising monofilaments of 0.5 to 20 dtex and, said polyethylene terephthalate fiber having a conjugate structure congregated a conductive carbon black in a central portion and a volume resistivity of $10^0$ to $10^6$ Ωcm and, said nylon-66 fiber having a volume resistivity of not less than $10^{13}$ Ωcm, installed as a cleaning brush.

10. An electrophotographic copying device, which comprises a conductive brush, comprising a base fabric and a mixed fiber of a polyethylene terephthalate fiber and a nylon-66 fiber being raised on the base fabric by pile-flocking and, said polyethylene terephthalate fiber and/or said nylon-66 fiber having a volume resistivity of $10^0$ to $10^6$ Ωcm and, said base fabric comprising a multifilament of 40 to 130 dtex as a weft (T) and a warp (Y) and, said polyethylene terephthalate fiber and said nylon-66 fiber constituting said mixed fiber being each a multifilament of 40 to 130 dtex comprising monofilaments of 0.5 to 20 dtex and, a part or all of said weft (T) and/or said warp (Y) in said base fabric comprising a thermoplastic resin having a melting point of 20 to 100° C. lower than those of said polyethylene terephthalate fiber and said nylon-66 fiber and, said polyethylene terephthalate fiber having a conjugate structure congregated a conductive carbon black in a central portion and a volume resistivity of $10^0$ to $10^6$ Ωcm and, said nylon-66 fiber having a volume resistivity of not less than $10^{13}$ Ωcm, installed as a cleaning brush.

* * * * *